US005523007A

United States Patent [19]

Kristen et al.

[11] Patent Number: 5,523,007

[45] Date of Patent: Jun. 4, 1996

[54] STABILIZED DIESEL ENGINE OIL

[75] Inventors: Ulrich Kristen, Riehen, Switzerland; Klaus Müller, Lörrach, Germany; Michael Rasberger, Riehen, Switzerland

[73] Assignee: Ciba-Geigy Corporation, Tarrytown, N.Y.

[21] Appl. No.: 393,522

[22] Filed: Feb. 23, 1995

Related U.S. Application Data

[63] Continuation of Ser. No. 750,712, Aug. 20, 1991, abandoned, which is a continuation of Ser. No. 629,098, Dec. 17, 1990, abandoned, which is a continuation of Ser. No. 405,373, Sep. 8, 1989, abandoned, which is a continuation-in-part of Ser. No. 157,825, Feb. 19, 1988, abandoned.

[30] Foreign Application Priority Data

Jul. 1, 1987 [CH] Switzerland ..... 2479/87

[51] Int. Cl.[6] ..... C10M 137/06

[52] U.S. Cl. ..... 252/32.7 E; 252/57

[58] Field of Search ..... 252/48.2, 48.6, 252/57, 32.7 E

[56] References Cited

U.S. PATENT DOCUMENTS

| | | | |
|---|---|---|---|
| 2,526,755 | 10/1950 | Kluge et al. | 252/48.2 |
| 3,179,591 | 4/1965 | Herbert, Jr. | 252/48.2 |
| 3,285,855 | 11/1966 | Dexter et al. | 252/48.2 |
| 3,330,859 | 4/1967 | Dexter et al. . | |
| 3,345,327 | 10/1967 | Dexter et al. . | |
| 3,457,286 | 7/1969 | Dexter et al. | 252/57 |
| 3,660,352 | 5/1972 | Song | 252/48.2 |
| 3,832,328 | 8/1974 | Eggensperger et al. | 252/48.2 |
| 4,618,440 | 10/1986 | Steinberg et al. | 252/48.2 |
| 4,652,272 | 3/1987 | Zaweski et al. . | |

*Primary Examiner*—Jacqueline V. Howard
*Attorney, Agent, or Firm*—William A. Teoli, Jr.

[57] ABSTRACT

A lubricant oil composition comprising a diesel engine lubricating oil and, as antioxidant, a compound of formula I

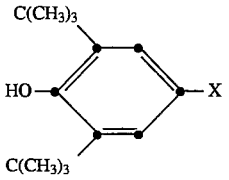

I wherein $R^1$ and $R^2$ are each independently of the other $C_1$–$C_{12}$alkyl and X is $$-CH_2-CH_2-\overset{\overset{\displaystyle O}{\|}}{C}-OR, \quad -CH_2-S-CH_2-\overset{\overset{\displaystyle O}{\|}}{C}-OR$$

or $-CH_2-S-R$ and R is a straight chain or branched alkyl radical of the formula $-C_nH_{2n+1}$, wherein n is an integer from 8 to 22.

20 Claims, No Drawings

STABILIZED DIESEL ENGINE OIL

This application is a continuation of Ser. No. 07/750,712, filed Aug. 20, 1991 now abandoned, which is a continuation of of application Ser. No. 07/629,098, filed Dec. 17, 1990, now abandoned, which is a continuation of application Ser. No. 07/405,373, filed Sep. 8, 1989, now abandoned, which is a continuation-in-part of application Ser. No. 07/157,825, filed Feb. 19, 1988, now abandoned.

The present invention relates to a diesel engine lubricating oil which is stabilised with an ester of a sterically hindered 3-(4-hydroxyphenyl) compound and to the use of said ester of 3-(3-hydroxyphenyl) compound for stabilising diesel engine lubricating oils.

Owing to the substantially greater load as compared with Otto engines and to the sulfur content of the diesel fuel, resistance to wear, oxidation and corrosion stability, low residue formation and nonsludging capacity are especially important for lubricant oils for diesel engines.

The life of diesel engines depends substantially on piston cleanliness as well as on the wear of the cylinder bore and on the wear of piston rings and bearings caused by mechanical abrasion and chemical corrosion. Abrasion is increased by engine soiling. Corrosive wear is mainly caused by the sulfur content of the fuel, which results in the formation of highly corrosive sulfur-containing acids. The higher thermal stresses in the piston area necessitate the use of detergent additives for effectively preventing increased coking and lacquering on the piston under these conditions. As diesel engines discharge more solid combustion products into the engine oil than do gasoline engines, dispersant additives are added to the lubricating oil to prevent sludge formation. In addition, the trend towards longer oil-change intervals requires an adequate stability to ageing of the lubricating oils for diesel engines.

These oils must not thicken appreciably over the entire running time and must prevent the formation of residues. Good thermal and oxidative stability is therefore essential.

Ash-free antioxidants of the alkylated diphenylamine or sterically hindered phenol type are not markedly effective in lubricant oils for diesel engines.

Esters of 3-(3,5-di-tert-butyl-4-hydroxyphenyl)propionic acid are disclosed as antioxidants for polymers, industrial oils and for diesel fuel in U.S. Pat. Nos. 3,285,855, 3,330,859, 3,345,327 and 4,652,272.

Surprisingly, it has now been found that esters of a sterically hindered 3-(4-hydroxyphenyl) compound are very effective antioxidants for diesel engine lubricating oils.

The present invention relates to a lubricant oil composition comprising a diesel engine oil and, as antioxidant, a compound of formula I

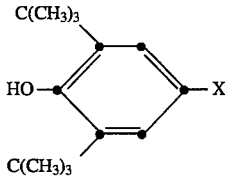

I wherein

X is $$-CH_2-CH_2-\overset{\overset{\displaystyle O}{\|}}{C}-OR, \quad -CH_2-S-CH_2-\overset{\overset{\displaystyle O}{\|}}{C}-OR$$

or $-CH_2-S-R$ and R is a straight chain or branched alkyl radical of the formula $-C_nH_{2n+1}$, wherein n is an integer from 8 to 22.

The $C_nH_{2n+1}$ radical denotes preferably straight chain $C_8$–$C_{22}$alkyl radicals. Most preferably the $C_nH_{2n+1}$ radical denotes a straight chain $C_8$–$C_{18}$alkyl radical.

R as $C_8$–$C_{22}$alkyl is for example octyl, nonyl, decyl, undecyl, dodecyl, tridecyl, tetradecyl, pentadecyl, hexadecyl, heptadecyl, octadecyl and others up to eicosyl, heneicosyl and docosyl. Preferred are $C_8$–$C_{22}$alkyl radicals as defined above, also preferred are $C_9$–$C_{18}$alkyl radicals as defined above.

R as octyl denotes for example n-octyl; 3,5-dimethylhexyl; 2-ethylhexyl; 3-ethylhexyl; 3,4-dimethyl-hexyl; 2,4-dimethyl-hexyl, 4-methyl-heptyl or 5-methyl-heptyl and mixtures of two or more or of all of the above octyl-rests.

A preferred lubricant oil composition is one in which the diesel engine oil is an engine oil of API classes CC, CD or class $CD^{(+)}$.

The API classes CC and CD are classifications of the American Petroleum Institute for engine oils. The C classes relate to diesel engine oils which, in accordance with their degree of doping and thus performance rating, are given a further letter in their classification.

Engine oils of the CC class conform to the requirements for diesel aspirating engines since 1961. They contain additives for the prevention of high- and low-temperature deposits and of corrosion (requirement according to MIL-L-2104 B).

Class CD engine oils conform to the requirements of supercharged diesel engines, also those powered by fuels of higher sulfur content. They contain additives for the prevention of high-temperature deposits, wear and corrosion.

The $CD^{(+)}$ class comprises engine oils for higher supercharged vehicle diesel engines which do not yet have an API classification. These oils are required above all in Europe, where engine oils are subjected to very high thermal stress on account of the high performance/weight ratio of the diesel engines.

The basis oil used for the preparation of engine oils of the aforementioned classes is normally a mineral oil. However, it can also consist of hydrogenated mineral oil distillates such as severely hydrotreated oil (refining hydrogenation, Ullmann's Encyclopedia of Industrial Chemistry, Vol. 10, pp. 690–699, Verlag Chemie, Weinheim, 1977) or hydrocracked oil (cleaving hydrogenation, Ullmann's Encyclopedia of Industrial Chemistry, Vol. 10, pp. 690–706, Verlag Chemie, Weinheim 1977) or synthetic components or mixtures thereof.

The synthetic oils comprise e.g. oils based on diesters, complex esters or poly-α-olefins.

A further preferred lubricant oil composition is one in which the diesel engine oil is a lubricant oil based on mineral oil, a synthetic oil or a mixture thereof, of SAE viscosity classes 15 W 40 or 30, and comprising 2.5 to 7.5% by weight of a detergent, 3.5 to 6.0% by weight of a dispersant and 1.2 to 1.8% by weight of a zinc dialkyldithiophosphate.

Yet a further preferred lubricant oil composition is one in which the diesel engine oil contains 0.5 to 2.0% by weight, preferably 0.75 to 1.5% by weight, of an antiwear additive in addition to the detergent, dispersant and zinc dialkyldithiophosphate.

Examples of detergents which are added to diesel engine oils are basic alkali metal sulfonates or alkaline earth metal sulfonates such as sodium, calcium and magnesium salts of long-chain alkylarylsulfonic acids or basic alkali metal or alkaline earth metal phenolates and salicylates.

The dispersants for diesel engine oils are for example polyisobutenylsuccinimides, polybutenylphosphonic acid derivatives or copolymers of vinyl acetate and fumaric acid esters.

The zinc dialkyldithiophosphates are preferably compounds of the general formula

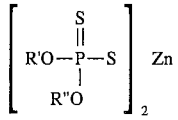

wherein R' and R" are each independently of the other $C_2$–$C_{12}$alkyl preferably $C_2$–$C_8$alkyl, and the total number of carbon atoms of R' and R" is at least 5.

The antiwear additives are for example polar, oil-soluble substances such as fatty alcohols, fatty acids, fatty acid esters or fatty acid amides whose activity increases with increasing molecular weight and in the sequence alcohol<ester<unsaturated acid<saturated acid.

A useful lubricant oil composition is also one comprising a diesel engine oil, an antioxidant of formula I and also, as additional antioxidant, a triarylphosphite, a trialkylphosphite, a mixed alkylarylphosphite and/or a thio compound of formula II

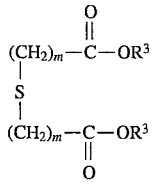

II wherein $R^3$ is $C_6$–$C_{24}$alkyl, preferably $C_{12}$–$C_{18}$alkyl, and m is an integer from 1 to 6.

Examples of triarylphosphites, trialkylphosphites and mixed alkylarylphosphites are triphenylphosphite, diphenylalkylphosphites, phenyldialkylphosphates, tris(nonylphenyl)phosphite, trilaurylphosphite, trioctyldecylphosphite, distearylpentaerythritol diphosphite, tris(2,4-di-tert-butylphenyl)phosphite, diisodecylpentaerythritol diphosphite, bis(2,4-di-tert-butylphenyl)pentaerythritol diphosphite, tristearyl sorbitol triphosphite.

Examples of compounds of formula II are dilaurylthiodipropionate and distearylthiopropionate.

A further interesting lubricant oil composition is one which contains a compound of formula I, wherein n is an integer from 8 to 22 and is preferably 8 or 18.

A particularly interesting lubricant oil composition is one in which the compound of formula I is n-octadecyl-3-(3,5-di-tert-butyl-4-hydroxyphenyl)propionate or is octyl-3-(3,5-di-tert-butyl-4-hydroxyphenyl)propionate.

In the compound of formula I: octyl-3-(3,5-di-tert-butyl-4-hydroxyphenyl)propionate, octyl preferably denotes a mixture containing the octyl rests n-octyl; 3,5-dimethylhexyl; 3-ethyl-hexyl; 3,4-dimethyl-hexyl; 2,4-dimethylhexyl; 4-methyl-heptyl and 5-methylhexyl.

Examples of compounds of formula I are:

n-nonyl-3-(5-tert-butyl-4-hydroxy-3-methylphenyl)propionate, 2-butyl-octyl-3-(3,5-di-tert-butyl-4-hydroxyphenyl)propionate, n-eicosyl-3-(3,5-di-tert-butyl-4-hydroxyphenyl)propionate, 2-hexyldecyl-3-(3,5-di-tert-butyl-4-hydroxy-3-methylphenyl)propionate, n-octadecyl-3-(3,5-di-tert-butyl-4-hydroxyphenyl)propionate, n-dodecyl-3-(3,5-di-tert-butyl-4-hydroxyphenyl)propionate.

The compounds of formula I are known and can be prepared in a manner known per se, for example by the methods described in U.S. Pat. specification Nos. 3,247,240, 4,085,132 and 4,228,297. Mercaptomethylphenols for use in compositions of the present invention are obtainable for example by a process as described in nonpublished European patent application 87810766.3. Any compounds which are novel can be prepared in analogous manner.

Preferred compositions of the present invention contain a compound of formula

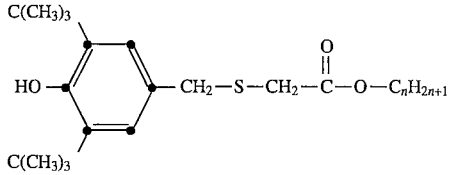

(Ia)

wherein n is an integer from 8 to 22, preferably from 8 to 18 and, most preferably, is 8 or 18.

Also preferred are compositions containing a compound of formula

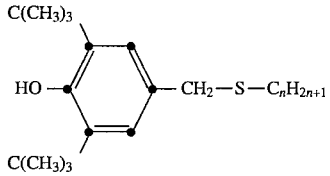

(Ib)

wherein n is an integer from 8 to 22, preferably from 8 to 18 and, most preferably, is 8 or 18.

The compounds of formula I are excellent antioxidants for diesel engine oils. They are added thereto preferably in an amount of 0.2 to 2.0% by weight, most preferably 0.5 to 1.5% by weight, based on the total weight of the lubricant oil composition.

Hence the present invention also relates to the use of compounds of formula I for stabilising diesel engine oil against oxidative degradation.

The diesel engine oils stabilised with the compounds of formula I may preferably be used in the following types of diesel engines:

high-speed vehicle diesel engines which are naturally aspirated or supercharged (automobiles, locomotives), marine diesel engines such as 4-cycle trunk-type piston engines, or 2-cycle crosshead diesel engines, gas diesel engines.

The lubricant oil compositions of this invention can contain still further additives which are added to the diesel engine oil to improve its basic properties further, for example viscosity modifiers.

Examples of viscosity modifiers are polymethacrylates, vinylpyrrolidone/methacrylate copolymers, polybutenes, olefin copolymers or styrene/acrylate copolymers.

In the following Examples parts and percentages are by weight, unless otherwise stated.

EXAMPLE 1

Engine test in a MWM test diesel engine in accordance with DIN 51 361 or CECL 12-A-76

The field of application of this test relates to engine oils. The purpose of the test is to assess the cleansing action of engine oils. This is done by testing principally the snug fit of the piston rings and the coke-like deposits in the piston ring grooves of diesel engines.

Piston cleanliness in the context of this standard denotes the ability of engine lubricating oils to keep the engine clean internally and to keep in check the unavoidable impurities stemming from combustion [extraneous oil contamination and by ageing substances which form in the engine lubricating oil (inherent oil contamination)].

a) Test procedure and test engine:

A new test piston is run in with the engine lubricating oil for testing in the test engine. There follows a 50 hour test run with a fresh oil supply under exactly defined and constantly maintained operating conditions of the test engine.

The test engine is a single cylinder four-cycle diesel engine, type MWM KD 12E. This engine is a rotochamber aspirating engine with an engine capacity of 0.85 1 (cylinder bore 95 mm, piston stroke 120 mm) and a highest useful compression ratio of 22.

Operating conditions of the engine during the test run

Test duration: 50 hours without interruption.

Gradual increase of engine speed and torque from start of operation so that the following engine speed and useful performance is reached after ca. 30 minutes:

engine speed: 2200 $min^{-1}$±25 $min^{-1}$ fuel consumption: 3100 g/h±40 g/h coolant inlet temperature: at least 100° C.

coolant outlet temperature: (110°±2)°C.

Amount of oil: 3.2 1; the weight must be determined and entered in the test report. The engine lubricating oil must not be replenished or drawn off during the test run.

Lubricating oil consumption: at most 1400 g for the 50 hour duration of the test run.

oil temperature in the crankcase: (110±2)°C.

oil pressure: 1.3 to 1.8 bar overpressure exhaust gas counterpressure: 25 to 45 mbar air suction temperature: 25° to 35° C.

density of exhaust smoke: density value according to Bosch: at most 4.

After the 50 hour test run, the piston cleanliness is evaluated by visual observation in accordance with DIN 51 361, Part 2.

The values corresponding to a specific piston cleanliness are reported in Table 1

TABLE 1

| Piston cleanliness | Evaluation factor |
|---|---|
| clean | 100 |
| discoloured | 65 |
| black | 30 |
| coke | −30 |

The 1st, 2nd and 3rd groove beds, the 2nd piston land, the piston head and piston skirt are evaluated.

At each site the product of the respective piston cleanliness and the area thereof is formed.

A mean value is computed for the measuring sites at the 1st, 2nd and 3rd groove bed and at the 1st and 2nd land of the piston.

b) Test procedure

The base oil is a formulated mineral oil of SAE viscosity class 15 W-40 with a TBN (total basic number) of 8.8 mg of KOH/g of mineral oil and having a Zn content of 0.11% by weight, a P content of 0.095% by weight, a Ca content of 0.25% by weight, a Mg content of 0.045% by weight and a sulfate ash content of 1.21% by weight.

This corresponds to a zinc dialkyldithiophosphate content of 1.2% by weight, a detergent content (magnesium sulfonate, calcium phenate) content of 3.5% by weight and a dispersant content of 3.5% by weight.

The oil additionally contains 8% by weight of a viscosity modifier (olefin copolymer). The oil is thus a diesel engine oil of API class CD.

The antioxidant of formula I of this invention is added to this base oil and the measurement is made as described in a).

The results are reported in Table 2.

TABLE 2

| Measuring site | Base oil | Base oil + 0.6% of AO | Base oil + 1.2% of AO |
|---|---|---|---|
| 1st groove bed | 18 | 40 | 27 |
| 2nd groove bed | 84 | 93 | 89 |
| 3rd groove bed | 100 | 100 | 100 |
| 1st land | 62 | 63 | 67 |
| 2nd land | 100 | 98 | 98 |
| Mean value | 73 | 79 | 76 |

AO = n-octadecyl-3-(3,5-di-tert-butyl-4-bydroxyphenyl)propionate

EXAMPLE 2

Following the procedure described in Example 1, the improvement in the cleansing action of a base oil of the following composition is tested by the addition of an antioxidant of formula I of this invention to said base oil.

Base oil: formulated mineral oil of SAE viscosity class 10 W-30 with a TBN (total basic number) of 5.5 mg of KOH/g of mineral oil and having a Zn content of 0.07% by weight, a P content of 0.07% by weight, a calcium content of 0.2% by weight and a sulfate ash content of 0.74% by weight. This corresponds to a zinc dialkyldithiophosphate content of 0.9% by weight, a detergent content (calcium sulfonate, calcium phenate) of 3.0% by weight, and a dispersant content of 3.5% by weight.

The oil additionally contains 6% by weight of a viscosity modifier (olefin copolymer). The oil is thus a diesel engine oil of API class CC.

The antioxidant is n-octadecyl-3-(3,5-di-tert-butyl-4-hydroxyphenyl)propionate.

The results are reported in Table 3

TABLE 3

| Measuring site | Base oil | Base oil + 0.6% of AO |
|---|---|---|
| 1st groove bed | 0 | 0 |
| 2nd groove bed | 22 | 71 |
| 3rd groove bed | 91 | 98 |
| 1st land | 44 | 53 |
| 2nd land | 86 | 93 |
| Mean value | 49 | 63 |

What is claimed is:

1. A method for reducing the formation of piston deposits in a diesel engine equipped with a lubricating system, which method comprises: supplying to the lubricating system of said diesel engine a diesel engine lubricating oil composition comprising a major amount of a lubricating oil, 2.5 to 7.5% by weight of a detergent, 3.5 to 6.0% by weight of a dispersant, 1.2 to 1.8% by weight of a zinc dialkyldithiophosphate and 0.2 to 2.0% by weight of a compound of formula I

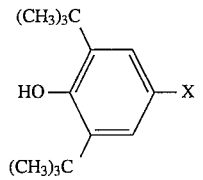

I wherein

X is $$-CH_2-CH_2-\overset{\overset{\displaystyle O}{\|}}{C}-OR,$$

and R is a straight chain or branched chain alkyl radical of the formula $-C_nH_{2n+1}$, wherein n is an integer from 8 to 22.

2. A method according to claim 1, wherein the lubricating oil is an engine oil of API classes CC, CD or class $CD^{(+)}$.

3. A method according to claim 1, wherein the lubricating oil is based on mineral oil, a synthetic oil or a mixture thereof, of SAE viscosity classes 15 W 40 or 30.

4. A method according to claim 1, wherein the diesel engine lubricating oil composition additionally contains 0.5 to 2.0% by weight of an antiwear agent.

5. A method according to claim 1, wherein the diesel engine lubricating oil composition additionally contains a triarylphosphite, a trialkylphosphite, a mixed alkylarylphosphite and/or a thio compound of formula II

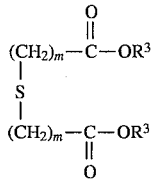

II wherein $R^3$ is $C_6$–$C_{24}$alkyl and m is an integer from 1 to 6.

6. A method according to claim 1, wherein the diesel engine lubricating oil composition contains 0.2 to 2.0% by weight of a compound of formula I, wherein n is an integer from 8 to 18.

7. A method according to claim 1, wherein the diesel engine lubricating oil composition contains 0.2 to 2.0% by weight of the compound octyl-3-(3,5-di-tert-butyl-4-hydroxy-phenyl)propionate.

8. A method according to claim 1, wherein the diesel engine lubricating oil composition contains 0.2 to 2.0% by weight of the compound n-octadecyl-3-(3,5-di-tert-butyl-4-hydroxy-phenyl)propionate.

9. A method according to claim 1, wherein the diesel engine lubricating oil composition additionally contains a viscosity modifier.

10. A method according to claim 9, wherein the viscosity modifier is selected from the group consisting of polymethacrylates, vinylpyrrolidone/methacrylate copolymers, polybutenes, olefin copolymers and styrene/acrylate copolymers.

11. A method for improving the deposit control properties of a diesel engine lubricating composition containing a major amount of a lubricating oil, 2.5 to 7.5% by weight of a detergent, 3.5 to 6.0% by weight of a dispersant, and 1.2 to 1.8% by weight of a zinc dialkyldithiophosphate, which method comprises: employing in said composition 0.2 to 2.0% by weight of a compound of formula I

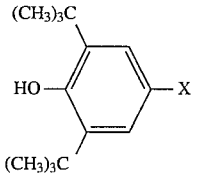

I wherein

X is $$-CH_2-CH_2-\overset{\overset{\displaystyle O}{\|}}{C}-OR,$$

and R is a straight chain or branched chain alkyl radical of the formula $-C_nH_{2n+1}$, wherein n is an integer from 8 to 22.

12. A method according to claim 11, wherein the lubricating oil is an engine oil of API classes CC, CD or class $CD^{(+)}$.

13. A method according to claim 11, wherein the lubricating oil is based on mineral oil, a synthetic oil or a mixture thereof, of SAE viscosity classes 15 W 40 or 30.

14. A method according to claim 11, wherein the diesel engine lubricating oil composition additionally contains 0.5 to 2.0% by weight of an antiwear agent.

15. A method according to claim 11, wherein the diesel engine lubricating oil composition additionally contains a triarylphosphite, a trialkylphosphite, a mixed alkylarylphosphite and/or a thio compound of formula II

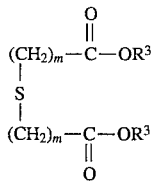

II wherein $R^3$ is $C_6$–$C_{24}$alkyl and m is an integer from 1 to 6.

16. A method according to claim 11, wherein the diesel engine lubricating oil composition contains 0.2 to 2.0% by weight of a compound of formula I, wherein n is an integer from 8 to 18.

17. A method according to claim 11, wherein the diesel engine lubricating oil composition contains 0.2 to 2.0% by weight of the compound octyl-3-(3,5-di-tert-butyl-4-hydroxy-phenyl)propionate.

18. A method according to claim 11, wherein the diesel engine lubricating oil composition contains 0.2 to 2.0% by weight of the compound n-octadecyl-3-(3,5-di-tert-butyl-4-hydroxy-phenyl)propionate.

19. A method according to claim 11, wherein the diesel engine lubricating oil composition additionally contains a viscosity modifier.

20. A method according to claim 19, wherein the viscosity modifier is selected from the group consisting of polymethacrylates, vinylpyrrolidone/methacrylate copolymers, polybutenes, olefin copolymers and styrene/acrylate copolymers.

* * * * *